United States Patent [19]

Smith

[11] Patent Number: 5,022,458

[45] Date of Patent: Jun. 11, 1991

[54] CONTROLLING THE POSITION OF LIQUID METAL IN A VESSEL

[75] Inventor: Robert A. Smith, Newbury, United Kingdom

[73] Assignee: Cosworth Casting Processes Limited, Worcester, United Kingdom

[21] Appl. No.: 462,026

[22] Filed: Jan. 8, 1990

[30] Foreign Application Priority Data

Jan. 10, 1989 [GB] United Kingdom ..... 8900492

[51] Int. Cl.[5] ..... B22D 17/32

[52] U.S. Cl. ..... 164/457; 164/155

[58] Field of Search ..... 164/4.1, 457, 150, 155

[56] References Cited

U.S. PATENT DOCUMENTS 2,509,079 5/1950 Trewin et al. .
2,937,789 5/1960 Tama .
3,961,662 6/1976 Balevski et al. ..... 164/155

FOREIGN PATENT DOCUMENTS 0037792 10/1981 European Pat. Off. .
0077950 5/1983 European Pat. Off. .
61-245955 11/1986 Japan ..... 164/457
803343 10/1958 United Kingdom .
1141153 1/1969 United Kingdom .
1483924 8/1977 United Kingdom .
2658507 6/1978 United Kingdom .
1595427 8/1981 United Kingdom .

*Primary Examiner*—Kuang Y. Lin
*Attorney, Agent, or Firm*—Parmelee, Miller, Welsh & Kratz

[57] ABSTRACT

A method of controlling the position of liquid metal in a mould cavity comprising the steps of feeding molten metal to the mould cavity, sensing the position of a surface of the metal in the cavity by a managing means responsive to electrical capacitance between sadi surface and a signal plate disposed externally of the liquid metal and adjacent to said surface, controlling the rate at which the molten metal is fed into the cavity in accordance with a control signal produced by said managing means so as to achieve a predetermined filling regime (as herein defined) governed by the position of said surface in the cavity.

24 Claims, 4 Drawing Sheets

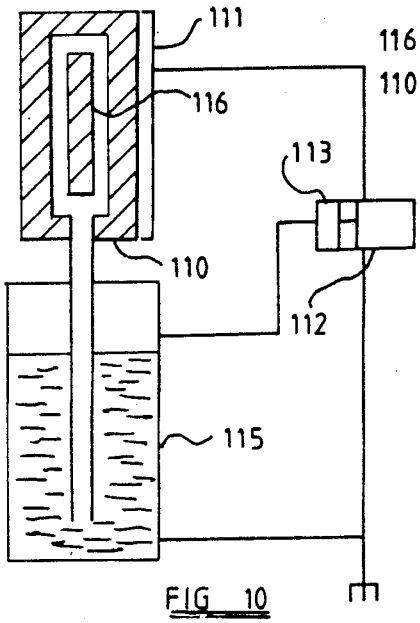
FIG 10
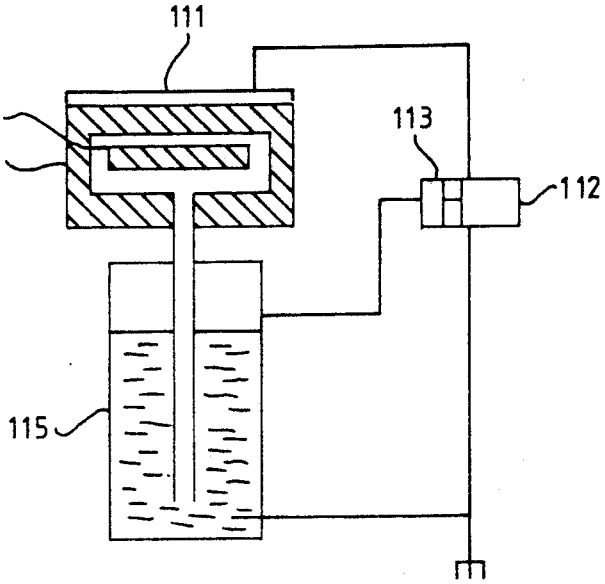
FIG 3
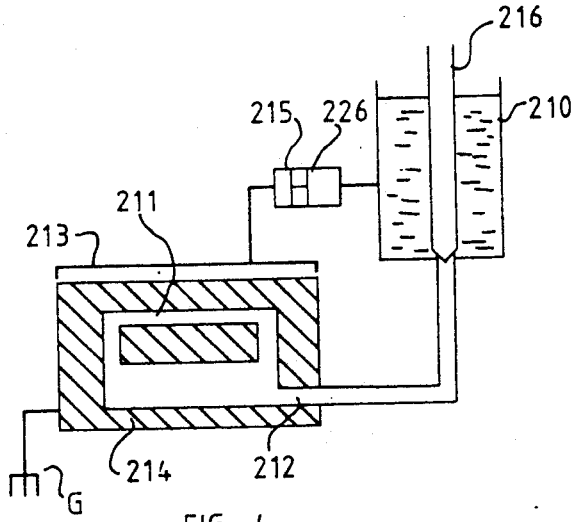
FIG 4
FIG 5
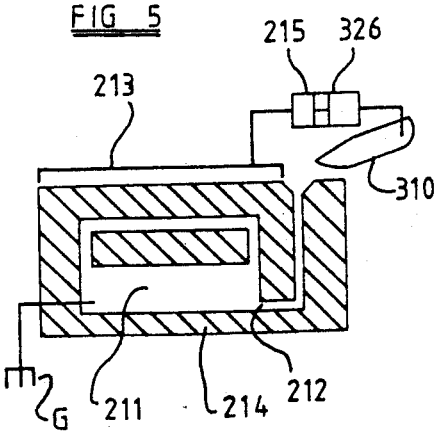

CONTROLLING THE POSITION OF LIQUID METAL IN A VESSEL

BACKGROUND OF THE INVENTION

This invention relates to a method of, and apparatus for, controlling the position of liquid metal in a vessel, such as a furnace or a mould.

An object of the invention is to provide a new and improved method of, and apparatus for thus controlling the position of liquid metal.

SUMMARY OF THE INVENTION

According to one aspect of the invention we provide a method of controlling the position of liquid metal in a mould cavity comprising the steps of feeding molten metal to the mould cavity, sensing the position of a surface of the metal in the cavity by a managing means responsive to electrical capacitance between said surface and a signal plate disposed externally of the liquid metal and adjacent to said surface, controlling the rate at which the molten metal is fed into the cavity in accordance with a control signal produced by said managing means so as to achieve a predetermined filling regime (as herein defined) governed by the position of said surface in the cavity.

The mould cavity may be of different cross-sectional area at different positions in the mould cavity in the direction of metal advance.

The managing means may comprise a micro-processor programmed to provide said predetermined filling regime.

The mould cavity may be defined in a sand mould or any other suitable kind of mould.

The metal may be fed into the mould cavity in any one of the following ways:

(a) downward pouring under gravity from a reservoir of liquid metal disposed above the level of the mould cavity;

(b) upward pouring under gravity from a reservoir of liquid metal disposed above the level of the mould cavity;

(c) upward pumping from a reservoir of liquid metal disposed below the level of the mould cavity by means of (i) a pressure difference between the mould cavity and the reservoir; either the reservoir being subjected to a pressure above atmospheric pressure or the cavity being subjected to a pressure below atmospheric pressure or to a combination thereof or (ii) a pump formed separately from the reservoir; either a fluid pressure pump or an electromagnetic pump.

The liquid metal may be fed to the mould cavity from a reservoir and the metal is fed to and/or fed from the reservoir so as to maintain the surface of the metal in the reservoir at a predetermined level or in a predetermined range of levels by sensing the position of a surface of the metal in the reservoir by a second managing means responsive to electrical capacitance between said surface of metal in the reservoir and a second signal plate disposed externally of the liquid metal and adjacent to said surface and controlling the rate at which liquid metal is fed to and/or fed from the reservoir in accordance with a control signal produced by said second managing means so as to achieve a predetermined level or range of levels in the reservoir both hereinafter encompassed by the latter term.

According to another aspect of the invention we provide an apparatus for controlling the position of liquid metal in a mould cavity comprising means to feed molten metal to the mould cavity, means to sense the position of a surface of the metal within the mould cavity including an electrical circuit in which the surface of the metal constitutes one plate of a capacitor and a signal plate disposed externally of the liquid metal and adjacent to said surface constitutes a second plate of the capacitor and the circuit including managing means to sense the electrical capacitance subsisting between the surface and the signal plate, fluid flow control means to control the rate at which the molten metal is fed into the cavity in accordance with a control signal produced by said managing means so as to achieve a predetermined filling regime governed by the position of said surface.

The mould cavity may be of different horizontal cross-sectional area at different vertical positions in the mould cavity in the direction of metal advance.

Said means to sense the position of said surface may be adapted to sense the position of the surface continuously during feed of metal to the cavity.

The managing means may include a capacity determining means which provides a signal responsive to the separation between the surface and the signal plate and which is fed to a control means which compares it with the separation predicted by said predetermined filling regime and provides a feedback control loop to said flow control means to achieve said predetermined filling regime.

The managing means may comprise a micro-processor programmed to provide a predetermined rate of advance of the surface of the metal in the mould cavity.

The electric circuit may comprise an oscillator to drive the signal plate relative to ground by an alternating current via a resistor to develop a signal voltage across the resistor which is rectified to provide a dc voltage proportional to the capacitive current component which voltage provides a signal proportional to the capacitance between the surface and the signal plate.

The mould may be a sand mould, or any other suitable kind of mould.

The means to feed metal into the mould cavity may comprise any one of the following:

(a) a reservoir for liquid metal disposed at a level above the mould cavity and means to permit liquid metal to be poured from the reservoir under gravity to a mould cavity through an ingate at or adjacent the top of the mould cavity;

(b) a reservoir for liquid metal at a level above the level of the mould cavity and means to pour liquid metal under gravity from the reservoir into the mould cavity through an ingate at or adjacent the bottom of the mould cavity;

(c) a reservoir for liquid metal at a level below the level of the mould cavity and means to pump liquid metal upwardly from the reservoir into the mould cavity and preferably through an ingate at or adjacent the bottom of the mould cavity.

The means for pumping the metal may comprise (i) means to establish a pressure difference between the mould cavity and the reservoir; the means may exert a pressure above atmospheric pressure on the metal in the reservoir or the means may establish a pressure below atmospheric pressure in the mould cavity or the means may establish a pressure above atmospheric on the metal in the reservoir and a pressure below atmospheric on the metal in the mould cavity or, (ii) a pump formed separately from the reservoir; in this case the pump may comprise a fluid pressure pump or an electromagnetic pump.

A guard plate to electrically screen the signal plate of the capacitor may be disposed so as to screen the second plate electrically from the remainder of the apparatus.

The signal plate of the capacitor and the guard plate may be provided by two electrically conducting surfaces provided on opposite faces of an insulating board.

The surfaces may be provided by deposited surfaces of a printed circuit board.

The signal plate and the guard plate may be provided with a non-conducting facing.

The signal plate of the capacitor may be adapted to be positioned in a predetermined position relative to the mould cavity.

The signal plate may be positioned above the top of the mould cavity and faces generally vertically downwardly.

The signal plate may be carried on a mould clamping mechanism whereby the mould cavity is maintained in feeding relationship with a feed or riser tube through which metal is fed from the reservoir.

The signal plate may be carried by a mould clamping mechanism and the guard plate is disposed between the second plate of the capacitor and the mould clamping mechanism.

Alternatively, the signal plate may be positioned laterally of the mould cavity and face generally laterally inwardly of the mould cavity.

The liquid metal may be fed to the mould cavity from a reservoir for liquid metal and means are provided to feed metal to and/or feed metal from the reservoir so that movement of the surface is controlled to maintain the surface in a predetermined range of levels by means to sense the position of the surface in the reservoir including an electric circuit in which the surface of the metal constitutes one plate of a second capacitor and a second signal plate disposed externally of the liquid metal and adjacent to said surface constitutes a second plate of the second capacitor and the circuit includes second managing means to sense the electrical capacitance subsisting between the surface and the second signal plate and there being second fluid flow control means to control the rate at which the molten metal is fed to and/or fed from the reservoir in accordance with a control signal produced by said second managing means so as to maintain the metal surface in said predetermined or range of levels.

By "a predetermined filling regime" we mean a rate of filling such as to cause the surface of the metal to advance at a predetermined rate during at least part of the feeding step. For example, the predetermined rate may be constant during part or all of the feeding step or may vary during part or all of the feeding step.

Where the rate varies the feeding step may finish with a rate of advance which is slower than a preceding rate of advance. For example, at the beginning of the feeding step a first rate of advance may be provided followed by a second rate of advance which is faster than the first rate of advance, followed by a third rate of advance which is slower than said first rate of advance. Other rates of advance intermediate the above mentioned rates of advance may be provided.

BRIEF DESCRIPTION OF THE DRAWINGS

Embodiments of the invention will now be described by way of example with reference to the accompanying drawings, wherein.

DESCRIPTION OF THE PREFERRED EMBODIMENTS

Figure 1:
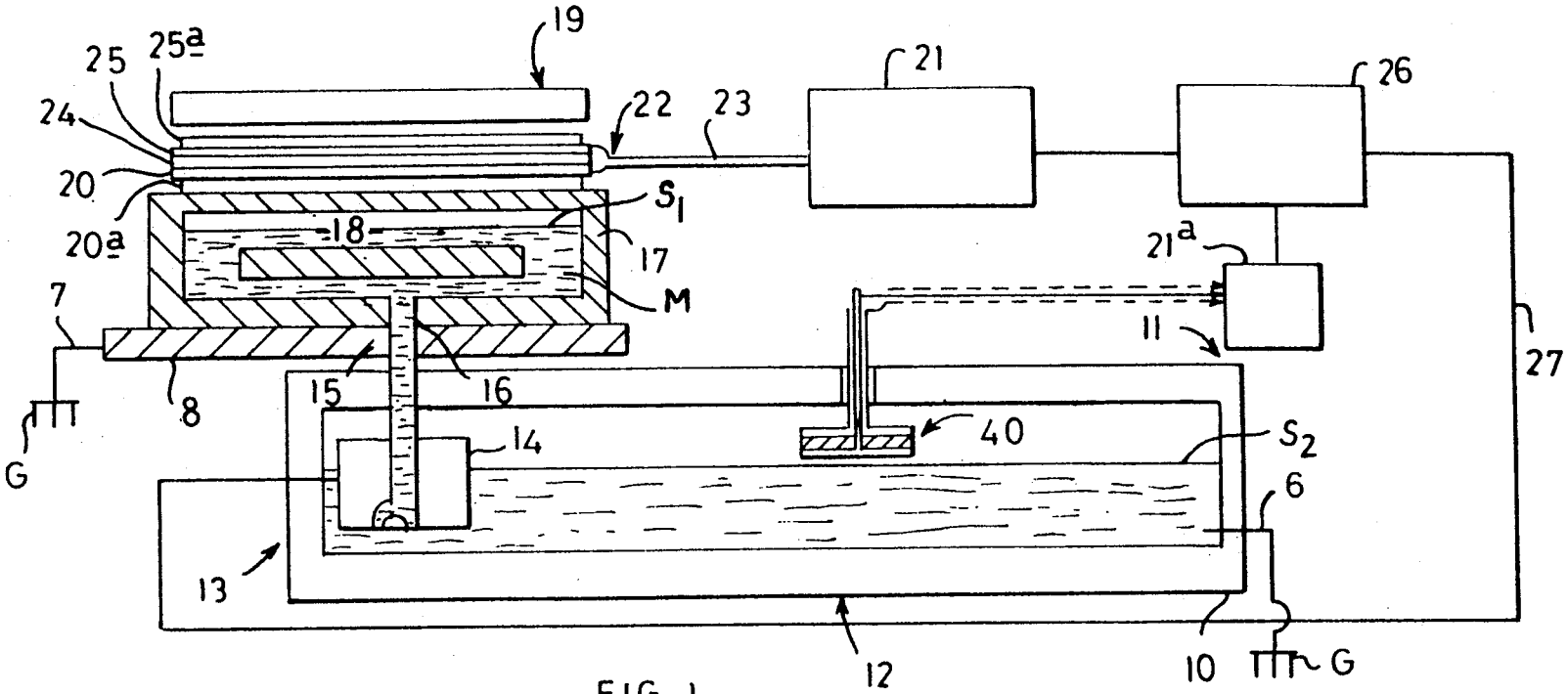
FIG. 1 is a diagrammatic illustration of a casting apparatus embodying the invention.
Figure 2:
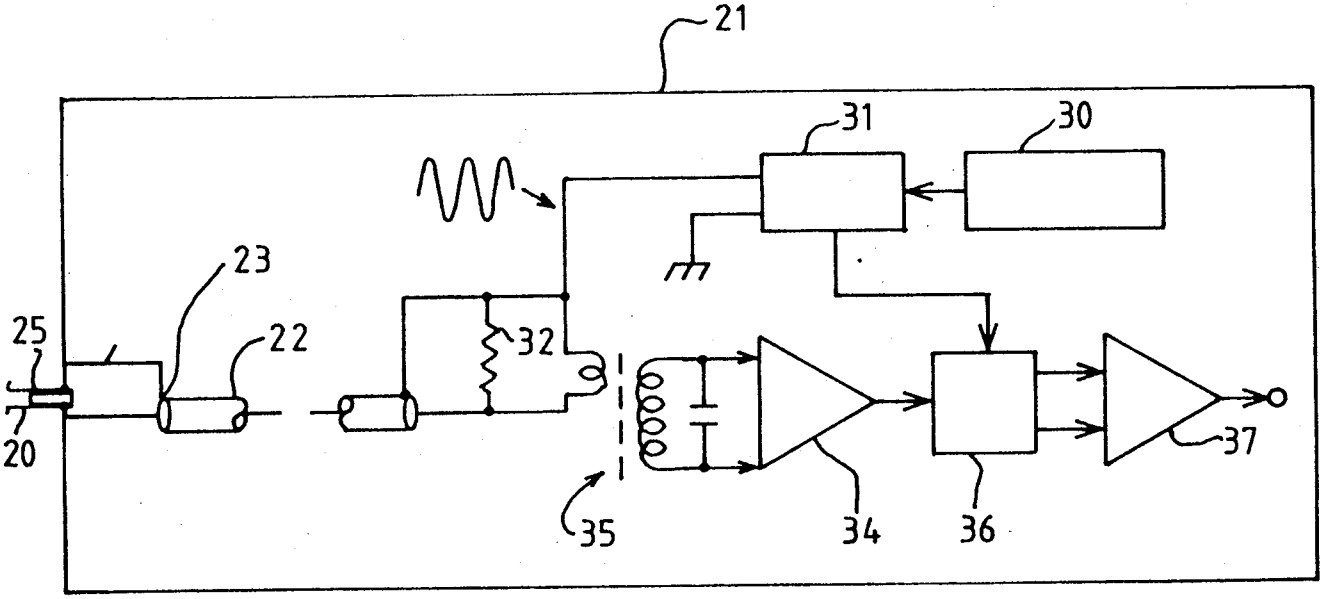
FIG. 2 is a circuit diagram of a capacity determining means of FIG. 1, FIGS. 3–5 and 10 are diagrammatic illustrations of three alternative embodiments of the invention.

Referring to the drawings there is shown a reservoir 10 for liquid metal M. In this example aluminium or an aluminium alloy, but the metal may be any suitable metal such as a magnesium alloy, a copper alloy, a zinc alloy, iron or steel. In this example the reservoir 10 comprises a melter/holder furnace to which metal is fed in solid state adjacent one end 11 of the reservoir and is melted by heat applied to a middle part 12 of the reservoir, whilst molten metal is pumped, at the other end 13 of the reservoir by means of a electromagnetic pump 14 formed separately from the remainder of the reservoir 10 and immersed therein. The pump 14 pumps liquid metal upwardly through a riser tube 15 which passes through the free surface 5 of the metal in the reservoir and engages an ingate 16 formed in the bottom of a mould 17 in which a mould cavity 18 is defined. The mould cavity 18 is of different horizontal cross-sectional area at different vertical positions in the mould cavity. The mould cavity can be of any desired suitable shape and may be of constant horizontal cross-sectional area throughout its height.

The mould 17 is urged downwardly onto a mould table 8, so as to maintain the top end of the riser tube 15 in sealing engagement with the ingate 16, by means of a mould clamping mechanism indicated diagrammatically at 19.

The level of the metal in the mould cavity is sensed by measuring the capacitance between a signal plate 20 and the metal. This capacitance increases as the metal rises from the bottom of the mould.

Since it is impractical to insulate the bulk metal in the furnace from ground (earth), steps are taken to ensure that the metal in the furnace is properly grounded, and the signal plate is driven by an alternating voltage relative to ground.

Thus the metal M in the mould cavity 18 is electrically connected to ground G by the metal in the riser tube 15 which is electrically connected to the mould support 8 which is connected to the ground G by a line 7. The metal in the reservoir 10 is connected to ground G by a line 6.

The plate 20 is carried by the mould clamping mechanism 19 and in the present example, comprises a layer of electrically conducting material deposited on a downwardly facing surface of an electrically insulating plate 24, whilst the upwardly facing surface of the plate 24 has a similar electrically conducting layer 25 deposited thereon. Conveniently, the plates 20, 24 and 25 are made as a double sided printed circuit board. The plate 25 comprises a guard plate to electrically shield the plate 20 from the capacitative effects of the metal parts of the clamping mechanism 19.

The plates 20 and 25 are each provided with a protective non-conducting facing such as rubber or ceramic as indicated at 20*a*, 25*a* respectively.

Provision is made so that the plate 20 is always positioned in the same position relative to the mould cavity, for example, by providing inter-engageable datum surfaces on the exterior of the mould 17 and a component fixed relative to the plate 20.

The plate 20 is connected to a capacity determining means 21 by an inner conductor of a co-axial cable 22 whilst the guard plate 25 is connected to the outer conductor 23 of the cable 22. The capacity determining means 21 comprises an oscillator 30 and a drive 31 and the signal plate is driven relative to ground by a sinewave at a suitable voltage and frequency (approximately 5 V rms and 32 KHz in the present example) via a small resistor 32. By making the resistor equal to, say, 50 ohms, the operation of the unit can be made independent of any length of 50 ohm co-axial cable 22 which may be connected between the signal plate 20 and the capacity determining means.

The sinewave "signal" current flowing between the signal plate and ground develops a signal voltage across the resistor. This voltage is fed to an amplifier 34 via a tuned transformer 35 which rejects unwanted signals at other frequencies, and provides common-mode isolation between the sinewave drive source and the grounded electronics. The amplified signal is rectified in a synchronous detector 36, using a phase reference, 90 degrees phase shifted relative to the signal plate drive waveform.

The synchronous detector 36 rejects any unwanted resistive component in the signal current (due to any leakage resistance which may exist from the signal plate to ground), and produces a dc voltage proportional to the capacitive (displacement) current component, and hence to the capacitance from the signal plate to ground. This dc voltage is conditioned by an amplifier 37 to a suitable level to provide an output signal.

It is convenient to place the signal plate above the mould. In this location, it would have a large capacitance to the mould clamping means 19. To avoid spurious signals due to this, the guard plate 25 is placed between the signal plate and the mould clamping means 19. This guard plate 25 is conveniently connected to the driven side of the current sensing resistor via the outer conductor 23 of the co-axial cable 22. Since the signal voltage developed across this resistor is very small, the guard plate 25 is at virtually the same ac potential as the signal plate, and negligible capacitive current flows between them. The capacitive current flowing from the guard plate 25 to the mould clamping means 19 and other surrounding grounded metalwork does not flow in the current sensing resistor, and so does not contribute to the signal current.

The output from the capacity determining means 21 provides a signal which varies in accordance with the capacitance existing between the plate 20 and the surface $S_1$ of the metal in the reservoir 18 and thus in accordance with the position of the surface $S_1$ of the metal in the mould cavity 18. The capacity is inversely proportional to the separation of the plates and thus by measuring the capacity one can measure the separation between the plate 20 and the surface $S_1$ and hence determine the position of the metal surface in the mould cavity 18. This signal provides an input to a control means 26 which conveniently comprises a micro-processor programmed with a suitable control algorithm and providing an output on a line 27 to the pump 14. The micro-processor is programmed with a desired filling regime or profile and by monitoring the position of the surface $S_1$ of the metal in the mould cavity 18 on a continuous basis in real time and providing a signal indicative of this to the control means 26, a feedback control loop to the pump 14 can be provided whereby the delivery of the pump can be varied whereby any departures from a predetermined desired filling profile or regime may be corrected.

By so doing, repeatable filling of castings in the desired manner is achieved. The rate of metal fed by the pump 14 is controlled by the voltage supplied to the pump and hitherto the voltage programme which the pump has been arranged to follow has been empirically determined on the assumption that the conditions attaining in the pump, the metal and mould are constant and repeatable. This has often proved not to be the case and therefore consistent filling of the mould cavity has not been attained. The present invention enables these shortcomings to be overcome.

Figure 6:
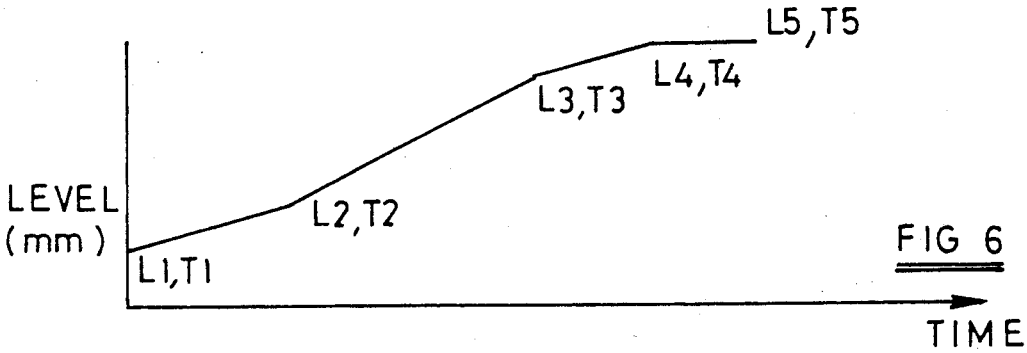

For example, FIG. 6 is a graph illustrating the variation of metal level with time in a particular moulding cavity where it was found that a good cast was achieved using the apparatus operated on an open loop basis. Using this graph, the micro-processor is programmed so as to store the desired profile illustrated in FIG. 6. For example, the micro-processor can be entered with the points L1, T1–L5, T5 or such other number of points as required to define the profile to the desired degree of accuracy in accordance with the profile shape in any particular situation.

The apparatus embodying the invention is then operated and initially the open loop voltage profile which results from the desired level profile shown in FIG. 6 is applied to the pump 14 causing the casting to fill. Such an open loop voltage profile is illustrated in FIG. 7.

Figure 7:
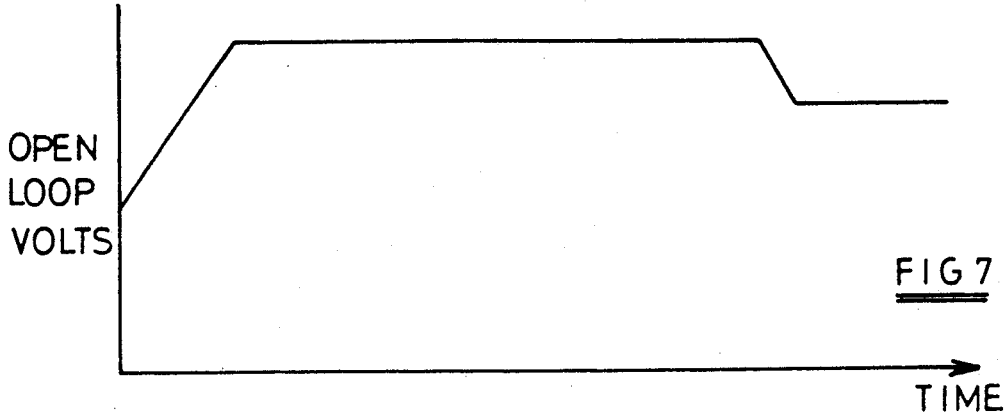
FIGS. 6–9 are graphs illustrating operation of the invention.
Figure 8:
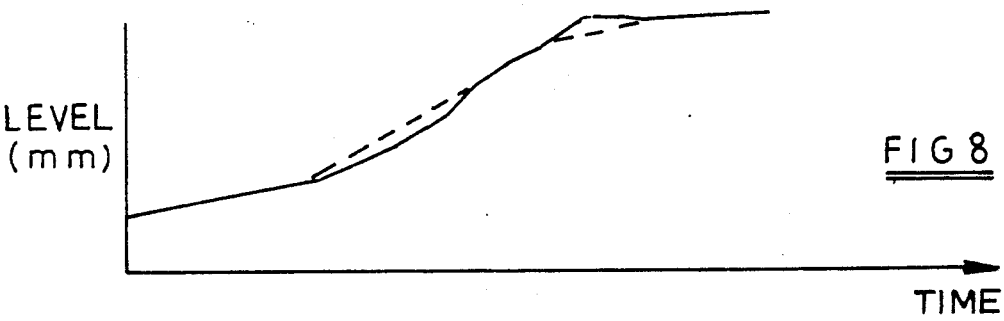

The micro-processor compares the level sensor output resulting from the application of the voltage profile shown in FIG. 7 with the desired profile referred to above and illustrated in FIG. 6 and a typical comparison is illustrated in FIG. 8 where the programmed level profile is shown in dotted line and the actual profile in full line.

Figure 9:
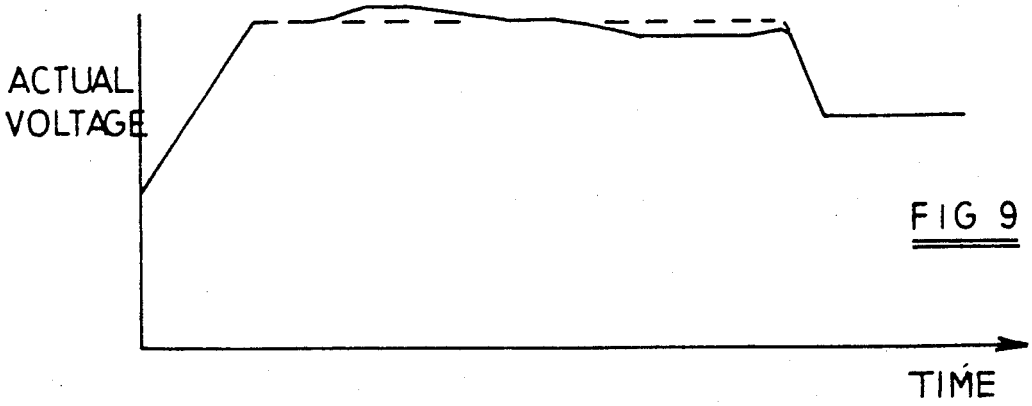

If the two profiles are different, as is illustrated in the example of FIG. 8, the micro-processor applies a trim voltage that is superimposed on the open loop voltage to reduce the difference, as illustrated in FIG. 9, where the programmed open loop voltage is again shown in dotted line and the actual voltage signal to be applied by the micro-processor is shown in full line.

The micro-processor is programmed with routines that ensure that the total voltage applied to the pump does not exceed a predetermined maximum value and the micro-processor also provides an output so that the trend of maximum positive trim voltages from casting to casting are recorded and displayed. These voltages providing a measure of pump performance.

It is preferred that the level of the metal in the reservoir 10 is also monitored so that, on the one hand, further metal may be added to the furnace at the end 11 or, if for some reason a supply of metal is not available, casting operations can be interrupted before the level of the metal in the reservoir 10 falls to such an extent that the pump 14 is unable to fill a mould cavity.

The level of the surface $S_2$ in the reservoir 10 may be sensed by a capacitance measuring system similar to that described hereinbefore in connection with the mould cavity 18. That is to say, a plate assembly 40, to provide a signal plate of a further capacitor is positioned above the surface $S_2$ so that the metal of the surface $S_2$ again provides the one plate of the capacitor and appropriate electrical shielding and mechanical protection is provided, conveniently by the assembly 40 being similar to the assembly 20*a*, 24, 25, 25*a* described hereinbefore. The two plates of the further capacitor thus formed are then connected electrically to a further capacitance measuring means 21*a* which provides an output dependent upon the level of the surface $S_2$ which provides a signal to the pump control 26 to prevent the pump 14 operating if the level $S_2$ falls below a predetermined level and/or to provide a signal to a feed means, not shown, to signal the feed means to feed further metal into the reservoir 10 as the level $S_2$ falls.

Although in the above example the metal has been described as being fed into the mould cavity 18 by an electromagnetic pump 14, if desired the pump may be any other suitable kind of pump, for example, a fluid pressure pump, particularly, for example, when the metal is iron or steel where an electromagnetic pump is not appropriate.

Such an arrangement is shown in FIG. 3 where a mould 110 is provided with a plate assembly 111, capacity determining means 112 and control means 113 similar to those described hereinbefore. In this case the control means 113 is adapted to control the gas pressure in the reservoir 115 and thereby control the feed of metal into a mould cavity 116 of the mould 110.

In addition, irrespective of the nature of the pump, the reservoir 10 may be a holding furnace to which molten metal is fed via a launder or by means of a ladle by another means. In this case the level of the metal in the reservoir 10 may be monitored as described hereinbefore as may be the level of the metal in an associated melting furnace with appropriate control signals being provided to feed metal from the melting furnace to the holding furnace and to control the supply of raw material to the melting furnace.

Irrespective of the nature of the reservoir, metal may be fed therefrom into the mould cavity by means other than upward pumping. For example, the mould cavity may be filled by conventional downhill pouring where metal flow is under gravity from a reservoir 210 which is, in this example, positioned at a level above the level of the mould cavity 211 and the metal entering the mould cavity through an ingate at or adjacent the top thereof. Alternatively and preferably, the ingate 212 may be positioned at or adjacent the bottom of a mould cavity 211 as shown in FIG. 4. In this case a plate assembly 213, similar to the assemblies described hereinbefore, is positioned adjacent the top of the mould 214 and connected to a similar capacity determining means 215, the output of which is used, via a suitably adapted version 226 of the control means 26 to control discharge from the reservoir 210, such as by means of a mechanically operated stopper rod 216.

In either of the above examples, instead of a reservoir, metal may be supplied by a ladle such as an auto ladle 310, as shown in FIG. 5. The auto ladle 310 is provided with means to control pouring of metal from the ladle in accordance with a control signal provided by a suitable adaptation 326 of the herebefore mentioned control means 26.

The mould 17, in the present example, comprises a conventional sand mould having cope and drag parts, but the mould may be of any desired type and may, for example, be of the full mould type or be made using bonded sand. Alternatively, the mould may be of the investment casting type being defined in a bonded ceramic material.

Although in the above example the signal plate has formed a capacitor with the top free surface of the metal in the cavity, if desired, particularly with a relatively tall and narrow cavity, the signal plate may be disposed laterally of the mould cavity and form a capacitor with a side surface of the metal in contact with a wall of the mould as shown in FIG. 10, which is a modification of the embodiment shown in FIG. 3 and hence the same reference numerals have been used. Such a signal plate disposition may be used in similar modifications of the other embodiments. In general, a signal plate can be disposed as appropriate relative to any desired suitable surface of the metal.

The features disclosed in the foregoing description, or the following claims, or the accompanying drawings, expressed in their specific forms or in terms of a means for performing the disclosed function, or a method or process for attaining the disclosed result, or a class or group of substances or compositions, as appropriate, may, separately or in any combination of such features, be utilised for realising the invention in diverse forms thereof.

What is claimed is:

1. A method of controlling the position of liquid metal in a mould cavity comprising the steps of feeding molten metal to the mould cavity, sensing the position of a surface of the metal in the cavity by a managing means responsive to electrical capacitance between said surface and a signal plate disposed externally of the liquid metal and adjacent to said surface, controlling the rate at which the molten metal is fed into the cavity in accordance with a control signal produced by said managing means so as to achieve a predetermined filling regime (as herein defined) governed by the position of said surface in the cavity.

2. A method according to claim 1 wherein the mould cavity is of different cross-sectional area at different positions in the mould cavity in the direction of metal advance.

3. A method according to claim 1 wherein the mould cavity is defined in a sand mould.

4. A method according to claim 1 wherein the metal is fed into the mould cavity by downward pouring under gravity from a reservoir of liquid metal disposed above the level of the mould cavity.

5. A method according to claim 1 wherein the metal is fed into the mould cavity through an ingate at or adjacent to the bottom of the mold cavity by upward pouring under gravity from a reservoir of liquid metal disposed above the level of the mould cavity.

6. A method according to claim 1 wherein the metal is fed into the mould cavity by upward pumping from a reservoir of liquid metal disposed below the level of the mould cavity.

7. A method according to claim 1 wherein the liquid metal is fed to the mould cavity from a reservoir and the metal is at least one of fed to and fed from the reservoir so as to maintain the surface of the metal in the reservoir in a predetermined range of levels by sensing the position of a surface of the metal in the reservoir by a second managing means responsive to electrical capacitance between said surface of metal in the reservoir and a second signal plate disposed externally of the liquid metal and adjacent to said surface and controlling at least one of the rate at which liquid metal is fed to and fed from the reservoir in accordance with a control signal produced by said second managing means so as to achieve a predetermined range of levels in the reservoir.

8. An apparatus for controlling the position of liquid metal in a mould cavity comprising means to feed molten metal to the mould cavity, means to sense the position of a surface of the metal within the mould cavity including an electrical circuit in which the surface of the metal constitutes one plate of a capacitor and a signal plate disposed externally of the liquid metal and adjacent to said surface constitutes a second plate of the capacitor and the circuit including managing means to sense the electrical capacitance subsisting between the surface and the signal plate, fluid flow control means to control the rate at which the molten metal is fed into the cavity in accordance with a control signal produced by said managing means so as to achieve a predetermined filling regime governed by the position of said surface.

9. An apparatus according to claim 8 wherein the mould cavity is of different cross-sectional area at different positions in the mould cavity in the direction of metal advance.

10. An apparatus according to claim 8 wherein the managing means includes a capacity determining means which provides a signal responsive to the separation between the surface and the signal plate and which is fed to a control means which compares it with the separation predicted by said predetermined filling regime and provides a feedback control loop to said flow control means to achieve said predetermined filling regime.

11. An apparatus according to claim 8 wherein the managing means comprises a micro-processor programmed to provide a predetermined rate of advance of the surface of the metal in the mould cavity.

12. An apparatus according to claim 8 wherein the electric circuit comprises an oscillator to drive the signal plate relative to ground by an alternating current via a resistor to develop a signal voltage across the resistor which is rectified to provide a dc voltage proportional to the capacitive current component which voltage provides a signal proportional to the capacitance between the surface and the signal plate.

13. An apparatus according to claim 8 wherein the mould is a sand mould.

14. An apparatus according to claim 8 wherein a guard plate to electrically screen the signal plate of the capacitor is disposed so as to screen said second plate of the capacitor electrically from the remainder of the apparatus.

15. An apparatus according to claim 14 wherein the signal plate of the capacitor and the guard plate are provided by two electrically conducting surfaces provided on opposite faces of an insulating board.

16. An apparatus according to claim 15 wherein the signal plate and the guard plate are provided with a non-conducting facing.

17. An apparatus according to claim 8 wherein the signal plate is positioned above the top of the mould cavity and faces generally vertically downwardly.

18. An apparatus according to claim 8 wherein the signal plate is positioned above the top of the mould cavity and faces generally vertically downwardly and wherein the signal plate is carried on a mould clamping mechanism whereby the mould cavity is maintained in feeding relationship with a feed or riser tube through which metal is fed from the reservoir.

19. An apparatus according to claim 8 wherein the signal plate is carried by a mould clamping mechanism and the guard plate is disposed between the signal plate of the capacitor and the mould clamping mechanism.

20. An apparatus according to claim 8 wherein the signal plate is positioned laterally of the mould cavity and faces generally laterally inwardly of the mould cavity.

21. An apparatus according to claim 8 wherein the liquid metal is fed to the mould cavity from a reservoir for liquid metal and there is provided at least one of a means to feed metal to and a means to feed metal from the reservoir so that movement of a surface of the metal in the reservoir is controlled to maintain the surface of the metal in the reservoir in a predetermined range of levels by means to sense the position of the surface of the metal in the reservoir including an electric circuit in which the surface of the metal in the reservoir constitutes one plate of a second capacitor and a second signal plate disposed externally of the liquid metal and adjacent to the surface of the metal in the reservoir constitutes a second plate of the second capacitor and the circuit includes second managing means to sense the electrical capacitance subsisting between the surface of the metal in the reservoir and the second signal plate and there being second fluid flow control means to control at least one of the rate at which the molten metal is fed to and fed from the reservoir in accordance with a control signal produced by said second managing means so as to maintain the surface of the metal in the reservoir at said predetermined range of levels.

22. An apparatus according to claim 8 wherein the means to feed metal into the mould cavity comprises a reservoir for liquid metal disposed at a level above the mould cavity and means to permit liquid metal to be poured from the reservoir under gravity to a mould cavity through an ingate at or adjacent the top of the mould cavity.

23. An apparatus according to claim 8 wherein the means to feed metal into the mould cavity comprises a reservoir for liquid metal at a level above the level of the mould cavity and means to pour liquid metal under gravity from the reservoir into the mould cavity through an ingate at or adjacent the bottom of the mould cavity.

24. An apparatus according to claim 8 wherein the means to feed metal into the mould cavity comprises a reservoir for liquid metal at a level below the level of the mould cavity and means to pump liquid metal upwardly from the reservoir into the mould cavity.

* * * * *